US009793611B2

(12) United States Patent
Leung et al.

(10) Patent No.: US 9,793,611 B2
(45) Date of Patent: Oct. 17, 2017

(54) ANTENNA

(71) Applicant: City University of Hong Kong, Kowloon (HK)

(72) Inventors: Kwok Wa Leung, Kowloon Tong (HK); Lei Guo, Kowloon Tong (HK); Yong Mei Pan, Tseung Kwan O (HK)

(73) Assignee: City University of Hong Kong, Hong Kong (HK)

( * ) Notice: Subject to any disclaimer, the term of this patent is extended or adjusted under 35 U.S.C. 154(b) by 268 days.

(21) Appl. No.: 14/816,225

(22) Filed: Aug. 3, 2015

(65) Prior Publication Data

US 2017/0040700 A1 Feb. 9, 2017

(51) Int. Cl.
*H01Q 21/00* (2006.01)
*H01Q 9/04* (2006.01)

(52) U.S. Cl.
CPC ..... *H01Q 9/0485* (2013.01)

(58) Field of Classification Search
CPC ..... H01Q 9/0485
USPC ..... 343/725
See application file for complete search history.

(56) References Cited

U.S. PATENT DOCUMENTS

| | | | |
|---|---|---|---|
| 3,710,340 | A | 1/1973 | Mayes |
| 3,868,694 | A | 2/1975 | Meinke |
| 4,972,196 | A | 11/1990 | Mayes |
| 7,589,686 | B2 | 9/2009 | Balzovsky |
| 7,843,389 | B2 | 11/2010 | Luk |
| 2010/0103061 | A1 | 4/2010 | Yung |

*Primary Examiner* — Graham Smith
(74) *Attorney, Agent, or Firm* — Renner Kenner Greive Bobak Taylor & Weber

(57) ABSTRACT

An antenna includes a dielectric resonator coupled to a ground plane provided on a substrate having a slot structure on the ground plane; and a monopole substantially surrounded by the dielectric resonator; wherein, when the monopole, the dielectric resonator and the slot structure are excited with an electrical signal, the combination of the monopole, the dielectric resonator and the slot structure is arranged to radiate an electromagnetic signal associated with the electrical signal in a substantially unidirectional manner.

28 Claims, 11 Drawing Sheets

ANTENNA

TECHNICAL FIELD

The present invention relates to an antenna for use in a communication system, although not exclusively, to a unidirectional ring dielectric resonator antenna with lateral radiation for use in a communication system.

BACKGROUND

In a radio signal communication system, information is transformed to radio signal for transmitting in form of an electromagnetic wave or radiation. These electromagnetic signals are further transmitted and/or received by suitable antennas.

Unidirectional antennas are used when there is a need to concentrate radiation in a desired direction. In some applications, such as office and household WiFi routers, the antenna is often placed off the room centre, e.g. beside a wall. In this case, unidirectional antennas with lateral radiation patterns are preferable to those with broadside radiation patterns. Large ground planes or cavities are needed in conventional lateral unidirectional antennas. It is desirable to reduce the size of the antenna so as to include the antenna in a more compact device and to reduce the visibility of the antenna.

SUMMARY OF THE INVENTION

In accordance with a first aspect of the present invention, there is provided an antenna comprising a dielectric resonator coupled to a ground plane provided on a substrate having a slot structure on the ground plane; and a monopole substantially surrounded by the dielectric resonator; wherein, when the monopole, the dielectric resonator and the slot structure are excited with an electrical signal, the combination of the monopole, the dielectric resonator and the slot structure is arranged to radiate an electromagnetic signal associated with the electrical signal in a substantially unidirectional manner.

In an embodiment of the first aspect, the combination of the dielectric resonator, the slot structure and the monopole defines a plurality of dipoles arranged to radiate the electromagnetic signal.

In an embodiment of the first aspect, the radiated electromagnetic signal has a complementary radiation pattern.

In an embodiment of the first aspect, the complementary radiation pattern in a first direction is defined by a construction interference of a plurality of electromagnetic radiation components contributed by the plurality of dipoles.

In an embodiment of the first aspect, the complementary radiation pattern in a second direction opposite to the first direction is defined by a destructive interference of the plurality of electromagnetic radiation components contributed by the plurality of dipoles.

In an embodiment of the first aspect, the plurality of dipoles comprises a magnetic dipole and an electric dipole perpendicular to the magnetic dipole.

In an embodiment of the first aspect, the plurality of dipoles comprises a horizontal magnetic dipole and a vertical electric dipole.

In an embodiment of the first aspect, the electromagnetic signal is radiated substantially along the first direction parallel to the ground plane.

In an embodiment of the first aspect, the magnetic dipole is defined by the combination of the dielectric resonator and the slot structure.

In an embodiment of the first aspect, the magnetic dipole is arranged to contribute at least one of the plurality of electromagnetic radiation components according to an $HEM_{11\delta+2}$ mode of the dielectric resonator and a slot-antenna mode of the slot structure.

In an embodiment of the first aspect, the electric dipole is defined by the monopole.

In an embodiment of the first aspect, the electric dipole is arranged to contribute at least one of the plurality of electromagnetic radiation components.

In an embodiment of the first aspect, the dielectric resonator comprises a hollow cavity along a central axis of the dielectric resonator.

In an embodiment of the first aspect, the monopole is substantially surrounded by the dielectric resonator within the hollow cavity along the central axis.

In an embodiment of the first aspect, the central axis is orthogonal to the ground plane.

In an embodiment of the first aspect, the slot structure substantially intercepts with the central axis.

In an embodiment of the first aspect, the slot structure is substantially elongated and perpendicular to a longitudinal axis on the ground plane.

In an embodiment of the first aspect, the slot structure is substantially offset from a midpoint on the ground plane along the longitudinal axis.

In an embodiment of the first aspect, further comprising a microstrip line on the substrate, wherein the microstrip line and the ground plane are provided on opposite sides of the substrate.

In an embodiment of the first aspect, the microstrip line is electrically connected to the monopole.

In an embodiment of the first aspect, the microstrip line is arranged to at least partially overlap with the slot structure on the substrate.

In an embodiment of the first aspect, the microstrip line is arranged to feed the slot structure.

In an embodiment of the first aspect, further comprising a connector on an edge of the substrate distal from the slot structure along the microstrip line.

In an embodiment of the first aspect, the central axis is positioned at where the microstrip line overlaps with the slot structure.

In an embodiment of the first aspect, the dielectric resonator is a cylindrical ring dielectric resonator.

In an embodiment of the first aspect, the monopole is a cone monopole, an inverted cone monopole, a cylindrical monopole or a step-radius monopole.

In an embodiment of the first aspect, the slot structure is etched on the ground plane of the substrate.

In accordance with a second aspect of the present invention, there is provided an antenna array comprising a plurality of antennas in accordance with the first aspect.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figure 1:
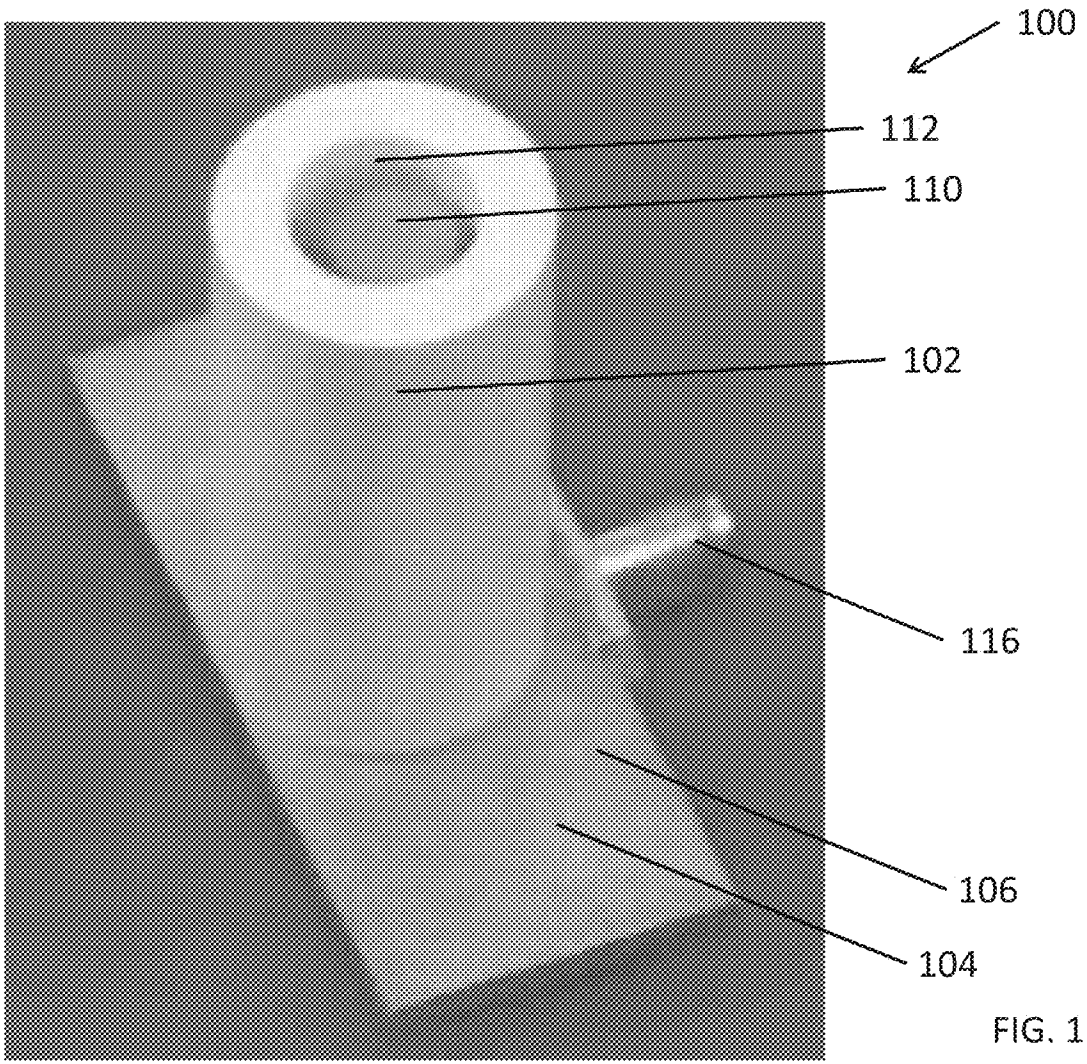
FIG. 1 is a perspective view of an antenna in accordance with one embodiment of the present invention.

With reference to FIGS. 1 to 5, there is shown an antenna 100 comprising a dielectric resonator 102 coupled to a ground plane 104 provided on a substrate 106 having a slot structure 108 on the ground plane 104; and a monopole 110 substantially surrounded by the dielectric resonator 102; wherein, when the monopole 110, the dielectric resonator 102 and the slot structure 108 are excited with an electrical signal, the combination of the monopole 110, the dielectric resonator 102 and the slot structure 108 is arranged to radiate an electromagnetic signal associated with the electrical signal in a substantially unidirectional manner.

In this embodiment, the dielectric resonator 102 is a cylindrical ring dielectric resonator having a hollow cavity 112 therein. The dielectric resonator 102 may be made of a dielectric material such as but not limited to ceramic or metal oxides. The dielectric resonator 102 is placed on a substrate 106 comprising a rectangular-shaped dielectric material with certain thickness. A layer of metal is provided on one side of the substrate 106 which forms a ground plane 104 of the antenna 100, and the dielectric resonator 102 is coupled to the side of the substrate 106 with the ground plane 104 thereon.

Figure 2:
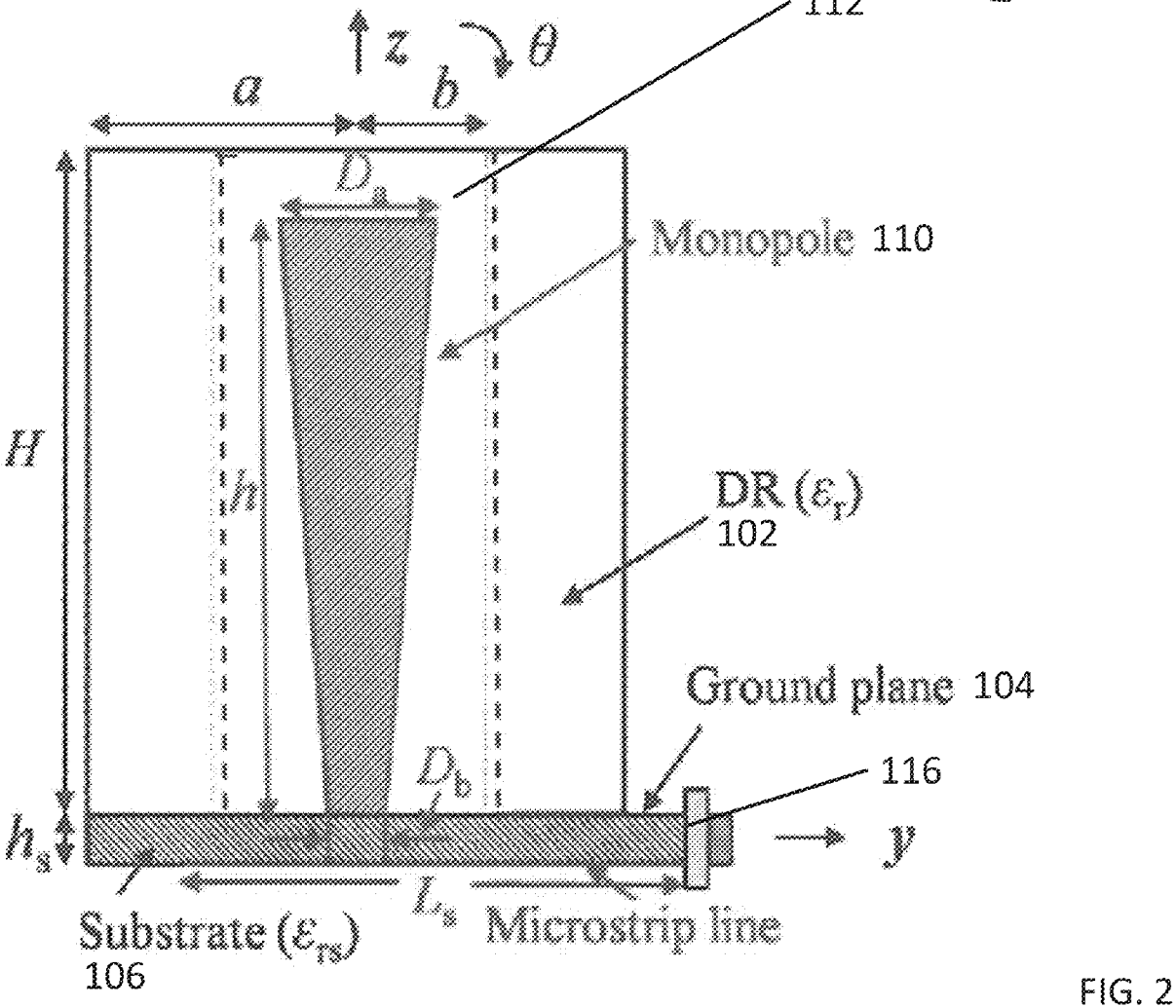
FIG. 2 is a side view of the antenna of FIG. 1.
Figure 3:
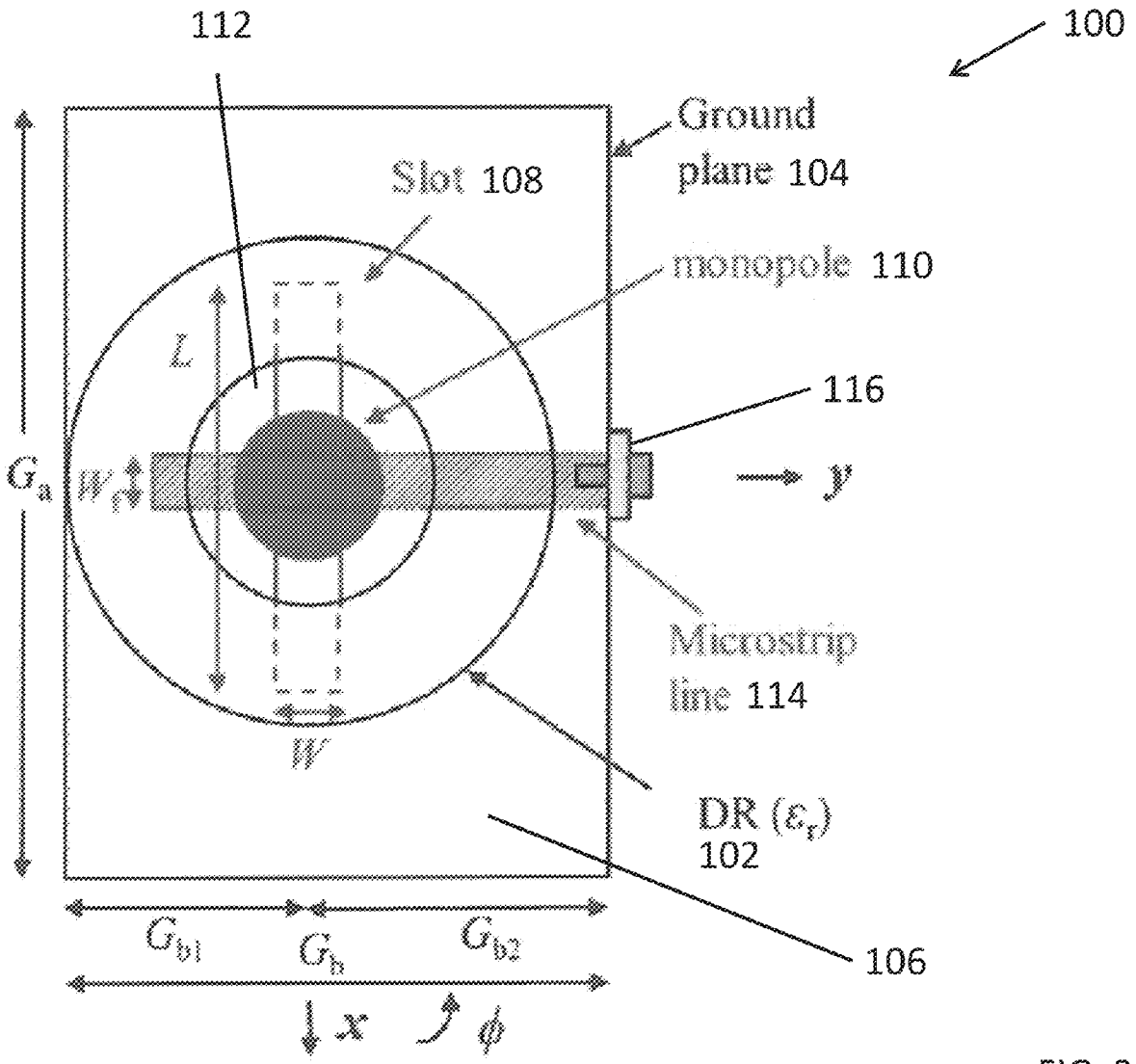
FIG. 3 is a top view of the antenna of FIG. 1.

Referring to the FIGS. 1 to 3, the dielectric resonator 102 and the hollow cavity 112 is provided along a central axis, preferably a single central axis. The central axis is substantially orthogonal to the ground plane 104 and/or the substrate 106 such that the ring cylindrical dielectric resonator 102 is basically perpendicularly placed on the substrate 106.

In some embodiments, the dielectric resonator 102 and/or the dielectric substrate 106 may be of other shapes and dimensions.

The antenna 100 also comprises a monopole 110 which is substantially surrounded by the ring dielectric resonator 102. As shown in the Figures, the monopole 110 is surrounded within the hollow cavity 112 defined by the ring dielectric resonator 102. The monopole 110 is an electrical conductor (such as a metal rod) arranged to receive an electrical signal and to radiate an electromagnetic signal when it is excited. Preferably, the monopole 110 is an inverted cone monopole with the narrower end attached to the substrate 106. Alternatively, the monopole 110 may be a cone monopole, a cylindrical monopole, a step-radius monopole or a monopole in any other shape as known by a skilled person.

The antenna 100 also comprises a slot structure 108 provided on the substrate 106. In this example, the slot structure 108 is substantially elongated, and is provided on the ground plane 104, in which the metallic material of the metal layer forming the ground plane 104 is absent within this area of slot structure 108. The slot structure may be etched on the ground plane or may be fabricated on the substrate by any method as appreciated by a person skilled in the art.

Additionally, the antenna 100 comprises a microstrip line 114 on the substrate 106. The microstrip line 114 is positioned on the opposite side of the ground plane 104. Preferably, the microstrip line 114 is a thin strip of conductor (such as metal) arranged to feed the slot structure 108, therefore the microstrip line 114 at least partially overlap with the slot structure 108 on the opposite side of the substrate 106. The combination of the microstrip line 114 and the slot structure 108 can be considered as a slot-antenna structure within the antenna 100, and the microstrip line 114 is arranged to feed the slot structure 108.

Figure 4:
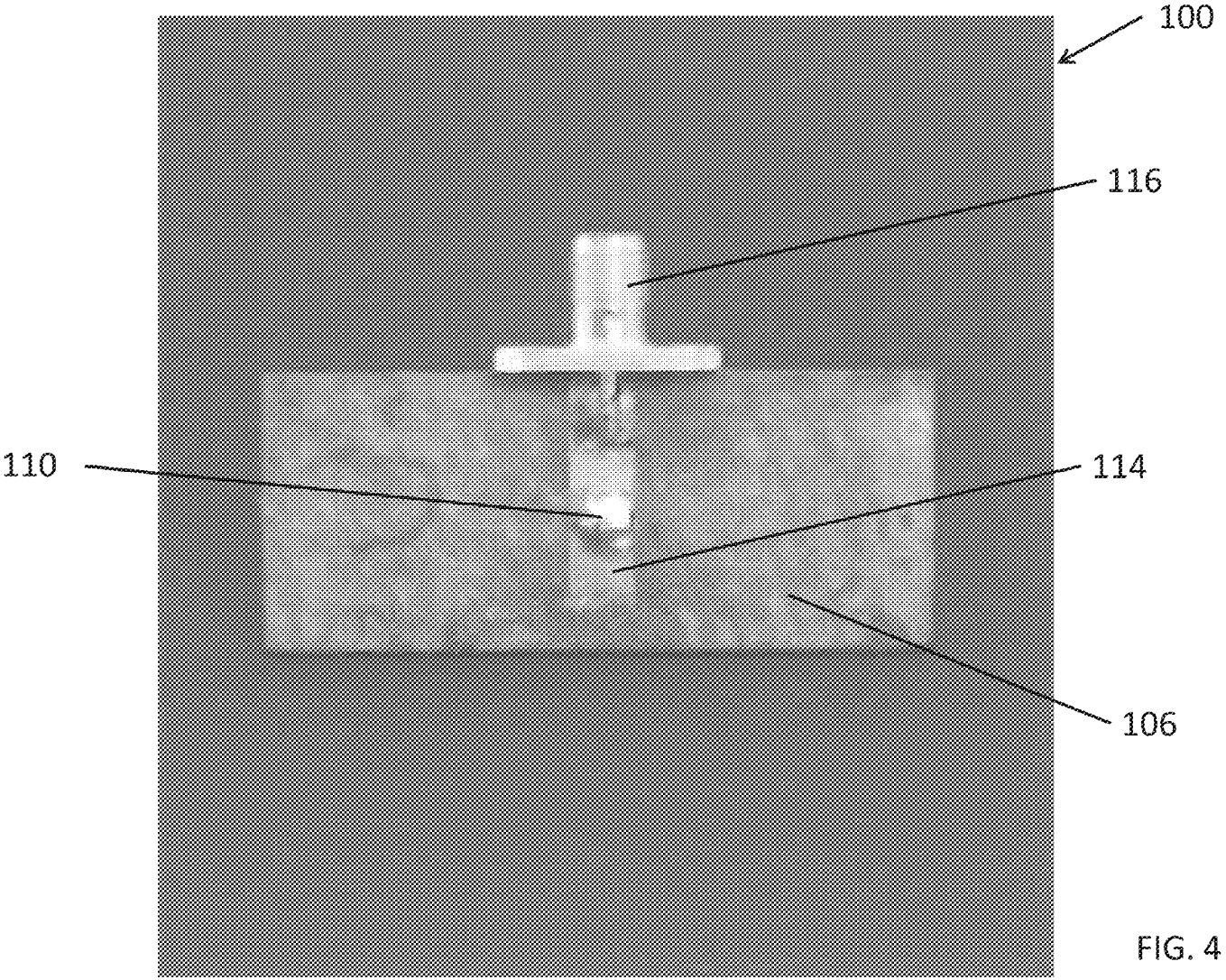
FIG. 4 is a bottom view of the antenna of FIG. 1.
Figure 5:
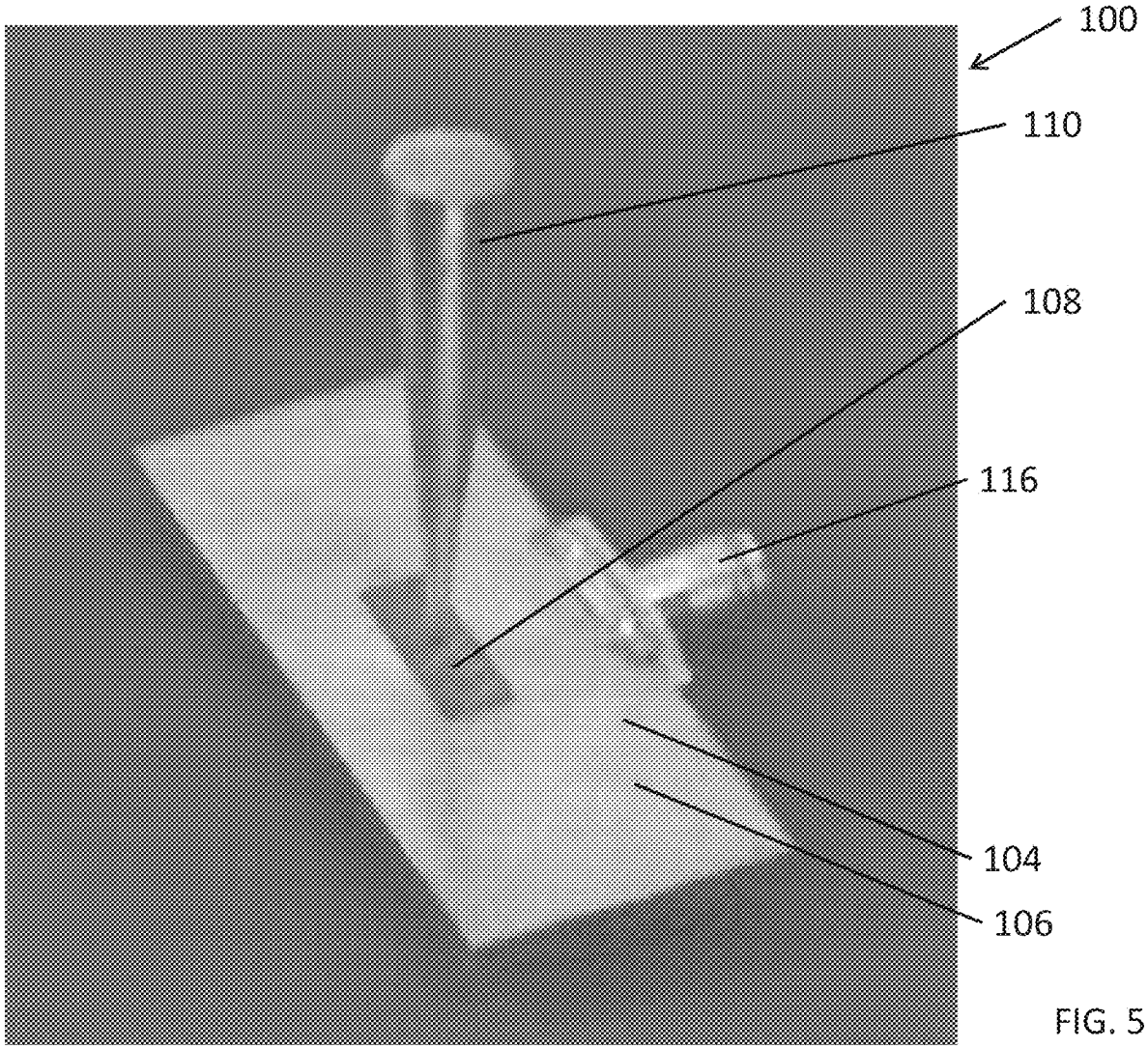
FIG. 5 is a perspective view of the antenna of FIG. 1 without the dielectric resonator.

Preferably, the microstrip line 114 is electrically connected to the monopole 110. With reference to FIG. 4, the monopole 110 penetrates through the substrate 106 and is soldered to the microstrip line 114. Hence, when the microstrip line 114 feed the slot structure 108, the electrical signal is also provided to the monopole 110.

Referring to FIGS. 2 and 3, the cylindrical ring dielectric resonator 102 includes an inner radius of b, an outer radius of a, a height of H and a dielectric constant of $\epsilon_r$. Based on different requirements or applications, different dielectric material with different dielectric constant $\epsilon_r$ may be chosen to form the dielectric resonator 102. The cylindrical ring dielectric resonator 102 is placed on the ground plane 104 of a rectangular substrate 106 with a dielectric constant of $\epsilon_{rs}$ and thickness of $h_s$. The substrate 106 has side lengths of $G_a$, $G_b$, ($G_a \neq G_b$), where $G_b = G_{b1} + G_{b2}$. Similarly, different dielectric material with different dielectric constant $\epsilon_{rs}$ may be chosen to form the substrate 106 based on different requirements or applications.

The slot structure 108 with a length L and width of W is fabricated on the ground plane 104. On the other side of the substrate 106, a 50-Ω microstrip line 114 with a length of $L_s$ and a width of $W_f$, printed or formed on the other side of the substrate 106 such that the slot structure 108 can be fed by the microstrip line 114.

The cone monopole 110 passes through the substrate 106 and protrudes into the hollow cavity 112 of the ring dielectric resonator 102. The monopole 110 has a height h, an upper diameter $D_a$, and a lower diameter $D_b$ as shown in the Figures.

With reference to the top view as shown in FIG. 3, the central axis of the dielectric resonator 102 and/or the monopole 110 intercepts with the slot structure 108, and preferably, the central axis is positioned at where the microstrip line 114 overlaps with the slot structure 108. The slot structure 108 is substantially elongated and is perpendicular to a longitudinal axis (the y axis as shown in FIG. 3). As a result, the microstrip line 114, the slot structure 108 and the monopole 110 at least partially overlap with each other, and the dielectric resonator 102 also overlaps (at least partially) with the slot structure 108 and/or the microstrip line 114.

Preferably, the antenna 100 has an asymmetric ground plane 104 with $G_{b1} \neq G_{b2}$, therefore the slot structure 108 is substantially offset from a midpoint on the ground plane 104 along the longitudinal axis (the y-axis). The main beam is along the −y direction and therefore $G_{b1}$ should be made as small as possible to minimize the titling effect due to the ground plane 104. In an exemplary example, $G_{b1}$ is set to be equal to the radius of the dielectric resonator 102 a, whereas $G_{b2}$ is only slightly (such as 2 mm) larger than $G_{b1}$. A connector 116 (such as an SMA connector 116) is provided on an edge of the substrate 106 distal from the slot structure 108 (at a distance of $G_{b2}$) along the microstrip line 114, and is soldered to the microstrip line 114 and the ground plane 104 for connecting to other components in a communication system.

The inventors have, through their own research, trials and experiments, devised that the x-directed magnetic dipole shows figures "O" and "∞" in the yz-plane (E-plane) and xy-plane (H-plane) radiation patterns, respectively, whereas the z-directed electric dipole has figures "∞" and "O", respectively. The complementary radiation patterns in one lateral direction have a constructive interference, whereas those in the other lateral direction have a destructive interference and therefore cancel each other. As a result, lateral unidirectional radiation patterns are obtained with good front-to-back ratios (FTBRs) in both radiation planes.

In an example embodiment, when the monopole 110, the dielectric resonator 102 and the slot structure 108 are excited with an electrical signal, such as when an amount of electrical energy is supplied to the microstrip line 114, the antenna 100 which comprises the combination of the monopole 110, the dielectric resonator 102 and the slot structure 108 is further arranged to transform the electrical signal to an electromagnetic signal and then radiate the electromagnetic signal in form of electromagnetic wave or radiation. As discussed earlier, the radiation pattern is unidirectional therefore the electromagnetic signal is radiated in a substantially unidirectional manner.

Preferably, the combination of the dielectric resonator 102, the slot structure 108 and the monopole 110 defines a plurality of dipoles arranged to radiate the electromagnetic signal, which include the magnetic dipole and the electric dipole discussed earlier. The magnetic dipole and the electric dipole are perpendicular configured to a complementary magnetic and electric dipole, so as to obtain the desired constructive and/or destructive interferences of the electromagnetic radiation components contributed by the plurality of dipoles when the antenna 100 is excited.

In this example, the magnetic dipole is defined by the combination of the dielectric resonator 102 and the slot structure 108. Preferably, an $HEM_{11\delta+2}$ mode of the dielectric resonator 102 combining a slot-antenna mode of the slot structure 108 is used as the required magnetic dipole, and the magnetic dipole contributes at least one of the plurality of electromagnetic radiation components. Alternatively, other mode of the dielectric resonator 102 may be used to obtain the equivalent magnetic dipole.

On the other hand, the electric dipole is defined by the monopole 110. The dielectric resonator-loaded monopole 110 is employed as the required electric dipole such that the electric dipole is arranged to contribute at least one of the plurality of electromagnetic radiation components.

Preferably, the electromagnetic signal radiated by the antenna 100 may include a complementary radiation pattern which may indicate the strength or power intensity of the electromagnetic signal radiated from the antenna 100. Specifically, the complementary radiation pattern in a first direction is defined by a construction interference of the electromagnetic radiation components contributed by the complementary magnetic and electric dipoles, whereas the complementary radiation pattern in a second direction opposite to the first direction is defined by a destructive interference of the electromagnetic radiation components contributed by the complementary magnetic and electric dipoles.

In a preferable embodiment, the antenna 100 comprises a horizontal magnetic dipole and a vertical electric dipole, and the electromagnetic signal is radiated substantially along a direction parallel to the ground plane 104 when the ground plane 104 is substantially parallel to the first direction defined above. Alternatively, the antenna 100 may be configured to radiate unidirectional electromagnetic signal in other directions in a three-dimensional space.

In another example embodiment, an antenna array comprising a plurality of antennas 100 may be implemented to increase the intensity of unidirectional radiated electromagnetic signal, and/or to introduce additional radiation directions of the electromagnetic signals.

These embodiments are advantageous in that the antenna comprises complementary sources with relatively small ground plane, such that the antenna has a compact size. It has a lateral radiation pattern rather than a broadside unidirectional radiation pattern. Hence the antenna may be widely used in different applications such as office and household wireless network routers being placed off the centre of a room.

Advantageously, the antenna is mainly made of dielectric material, hence the antenna may achieve a very low-loss even at millimetre-wave frequencies and has a very high radiation efficiency. In addition, a wide range of dielectric material with different dielectric constants may be used for implementing the antenna, which allows designers to choose a dielectric material most suitable for different applications.

In an exemplary embodiment, the antenna 100 is configured to operate at 3.5 GHz WiMax band. ANSYS HFSS was used to design the DRA, with optimized parameters given by $\epsilon_r$=15, a=9 mm, b=5 mm, H=35 mm, $G_a$=48 mm, $G_{b1}$=9 mm, $G_{b2}$=11 mm, $\epsilon_{rs}$=2.33, $h_s$=1.57 mm, W=4.4 mm, L=12.4 mm, $L_s$=16.7 mm, $W_f$=4.66 mm, $D_a$=7.2 mm, $D_b$=0.6 mm, and h=33.2 mm.

In an experiment, the reflection coefficient was measured using an Agilent network analyzer PNA 8753, whereas the radiation pattern, antenna 100 gain, and antenna 100 efficiency were measured using a Satimo StarLab system. To suppress the current on the outer conductor of the coaxial cable, an RF choke was used in the experiment.

Figure 6:
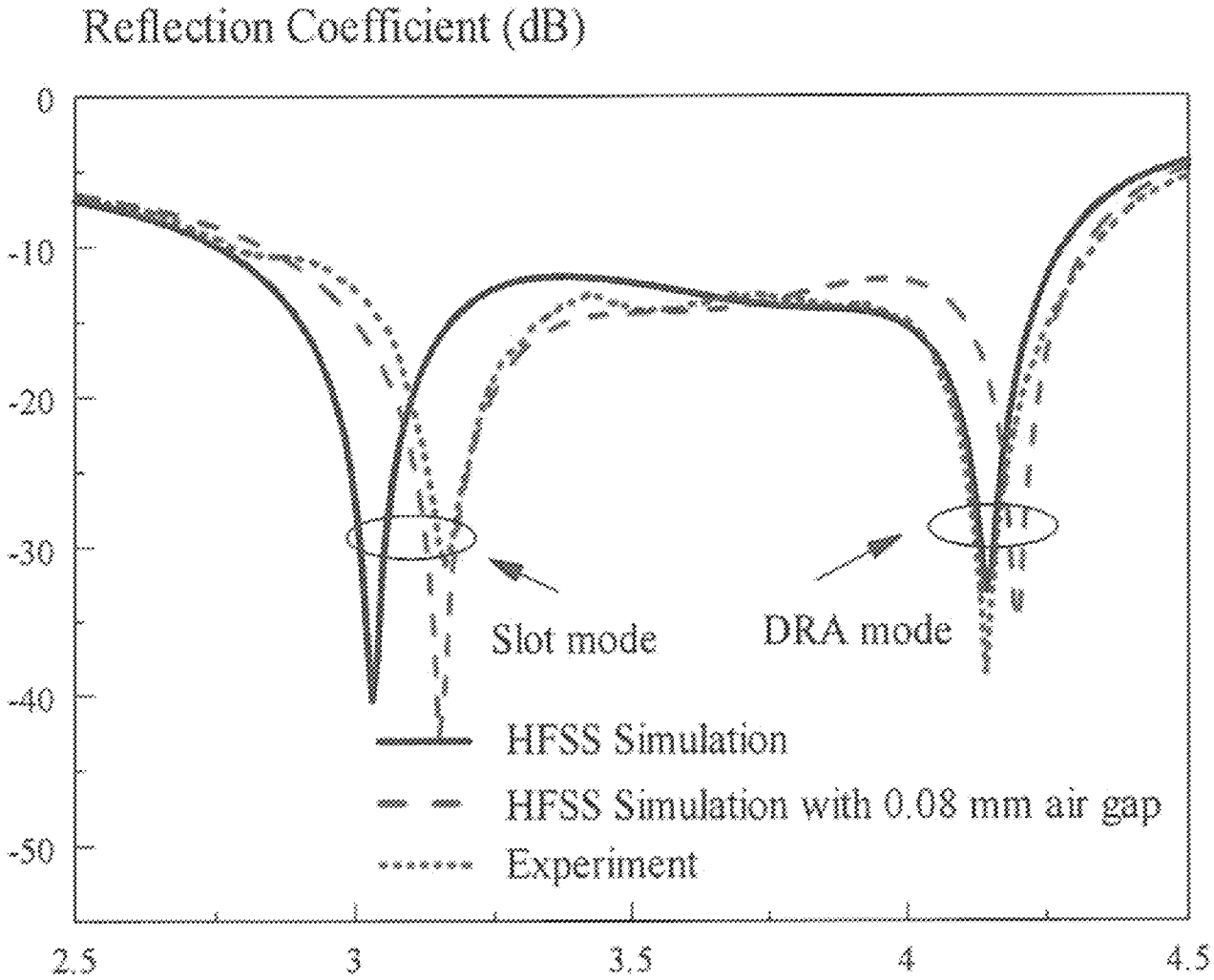
FIG. 6 is a plot showing measured and simulated reflection coefficients of the antenna of FIG. 1.

With reference to FIG. 6, there is shown the measured and simulated reflection coefficients of the antenna 100. Excellent agreement between the measured and simulated results is observed for the dielectric resonator 102 antenna (DRA) mode, but a discrepancy (4.3% frequency shift) in the slot mode is found. It was found that the discrepancy of the slot mode is mainly caused by the air gap between the DRA 102 and ground plane 104.

In another experiment, an air gap of 0.08 mm was introduced in the simulation and the result is also shown in FIG. 6 for ease of comparison. As can be observed from the figure, the measurement has much better agreement with the air gap result than with the original result. The measured impendence bandwidth is 43.6% (2.78-4.33 GHz), which agrees well with the original and new simulated results of 43.0% (2.76-4.27 GHz) and 41.34% (2.84-4.32 GHz), respectively. It can be noted from the figure that the air gap effect is stronger on the slot mode than on the DRA mode.

Figure 7:
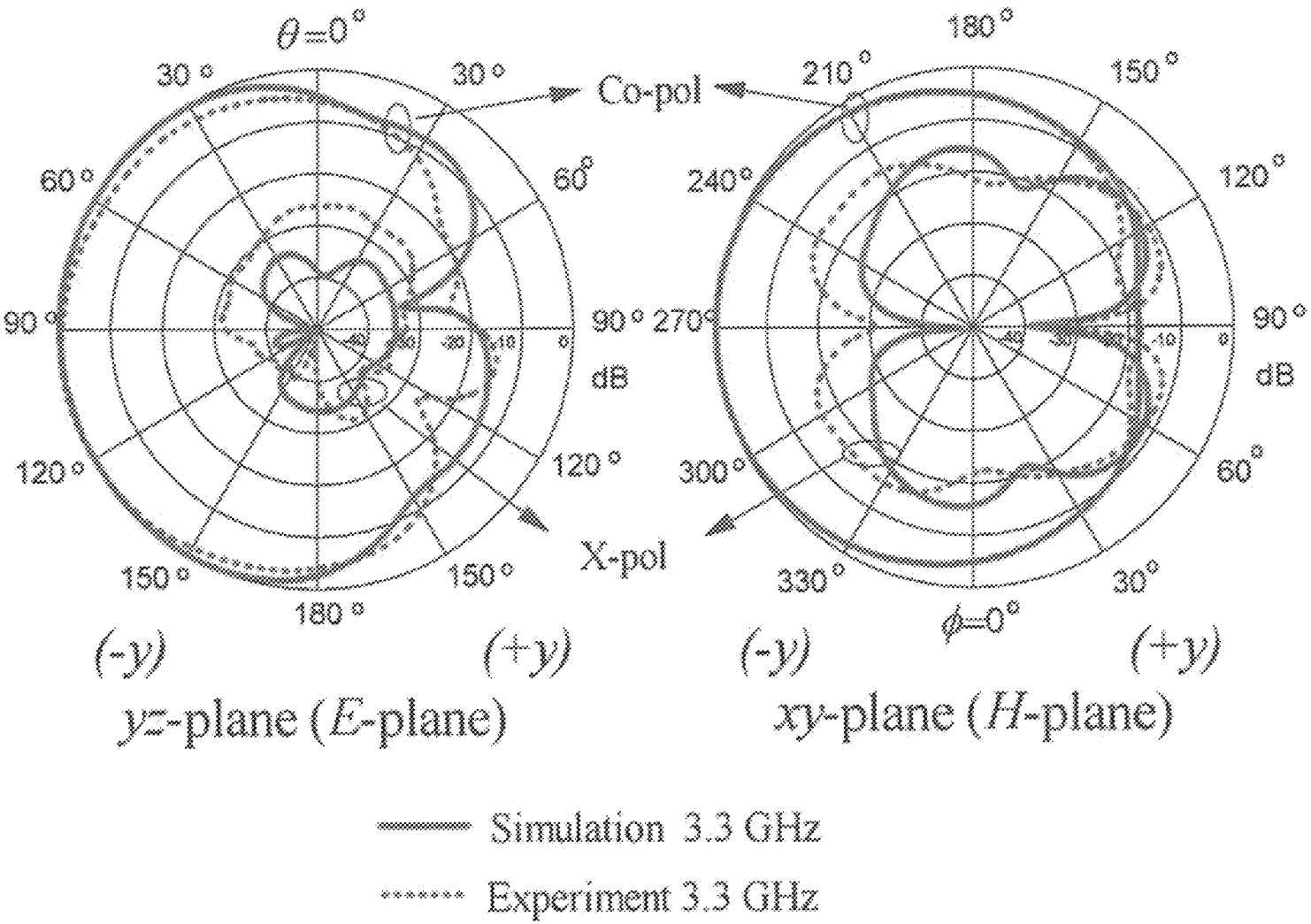
FIG. 7 is a plot showing measured and simulated radiation patterns of the antenna of FIG. 1 operating at 3.3 GHz.
Figure 8:
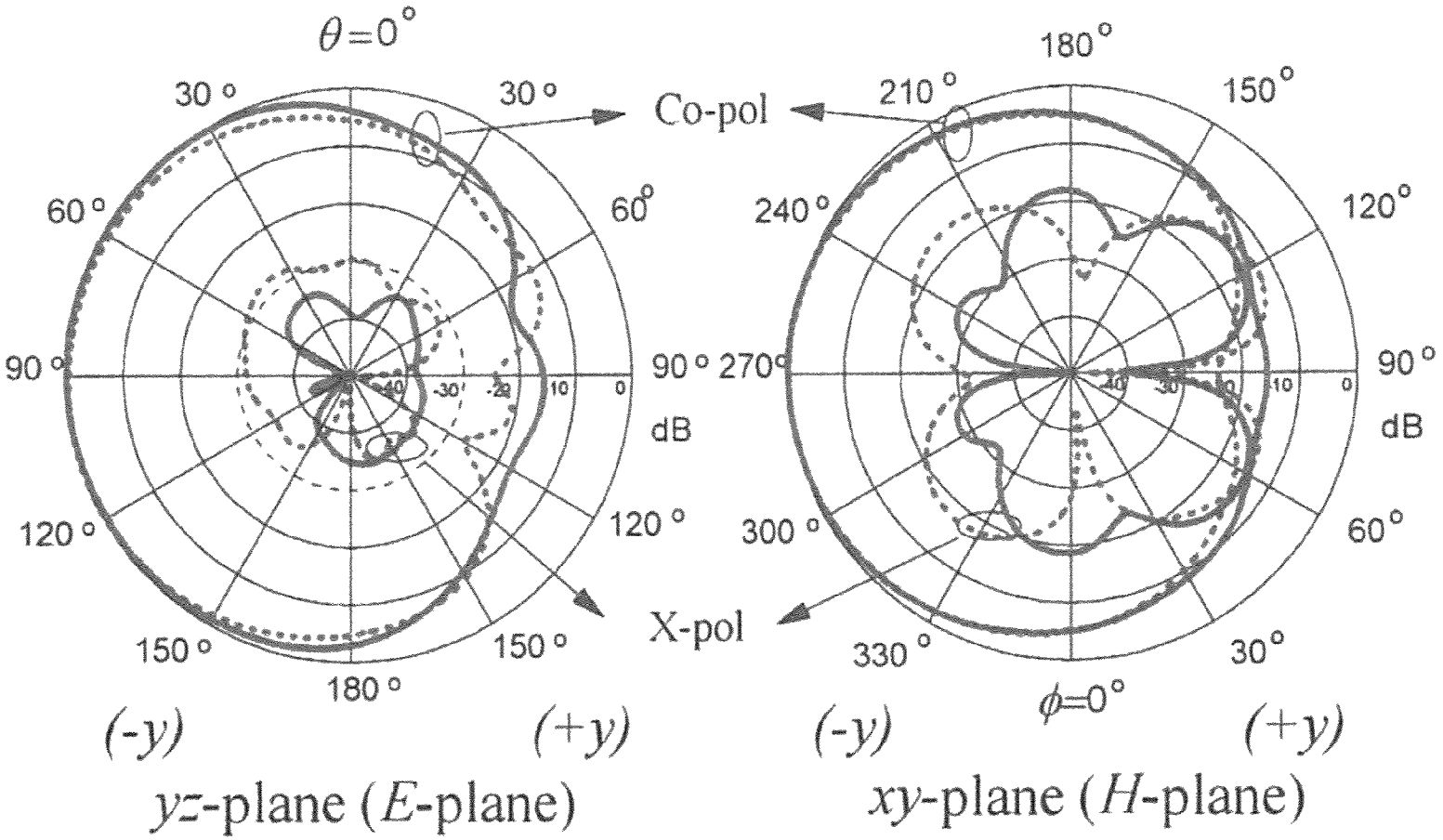
FIG. 8 is a plot showing measured and simulated radiation patterns of the antenna of FIG. 1 operating at 3.5 GHz.
Figure 9:
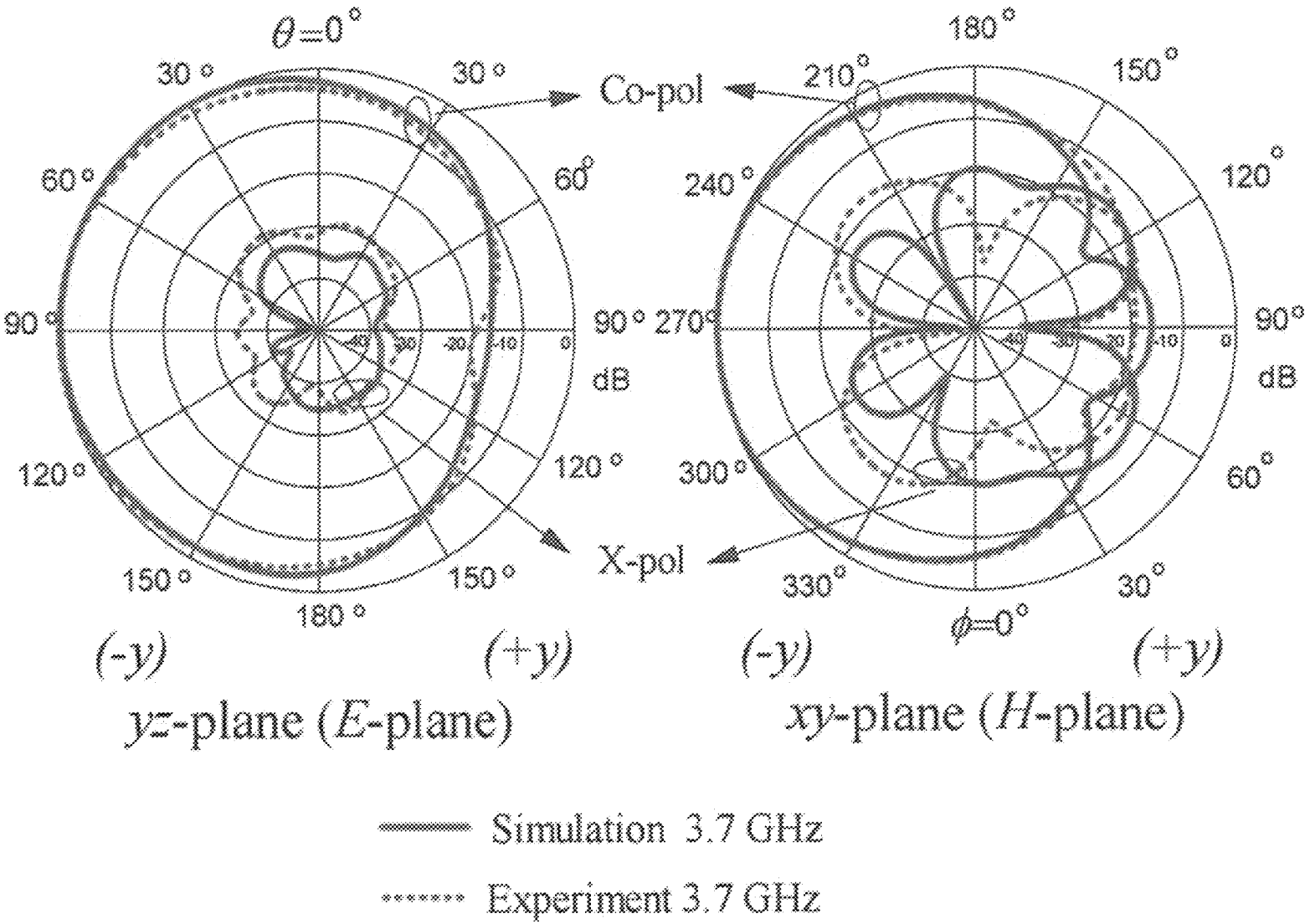
FIG. 9 is a plot showing measured and simulated radiation patterns of the antenna of FIG. 1 operating at 3.7 GHz.

With reference to FIGS. 7 to 9, the radiation patterns of the antenna 100 are provided. Stable lateral unidirectional radiation patterns are obtained. There is a small titling angle in the elevation plane due to the ground plane 104 effect, whereas very symmetric results can be observed for the azimuthal plane. In the designed frequency band (3.3-3.7 GHz), the measured beamwidth and FTBR are broader than 117° and higher than 17.75 dB, respectively.

Defining the FTBR bandwidth as the frequency range with FTBR>15 dB, it was then found from the simulation that the FTBR bandwidth is 15.34% (3.19-3.72 GHz). This is much narrower than the simulated impedance bandwidth (~43%) and thus, limits the operation bandwidth of the antenna 100.

Figure 10:
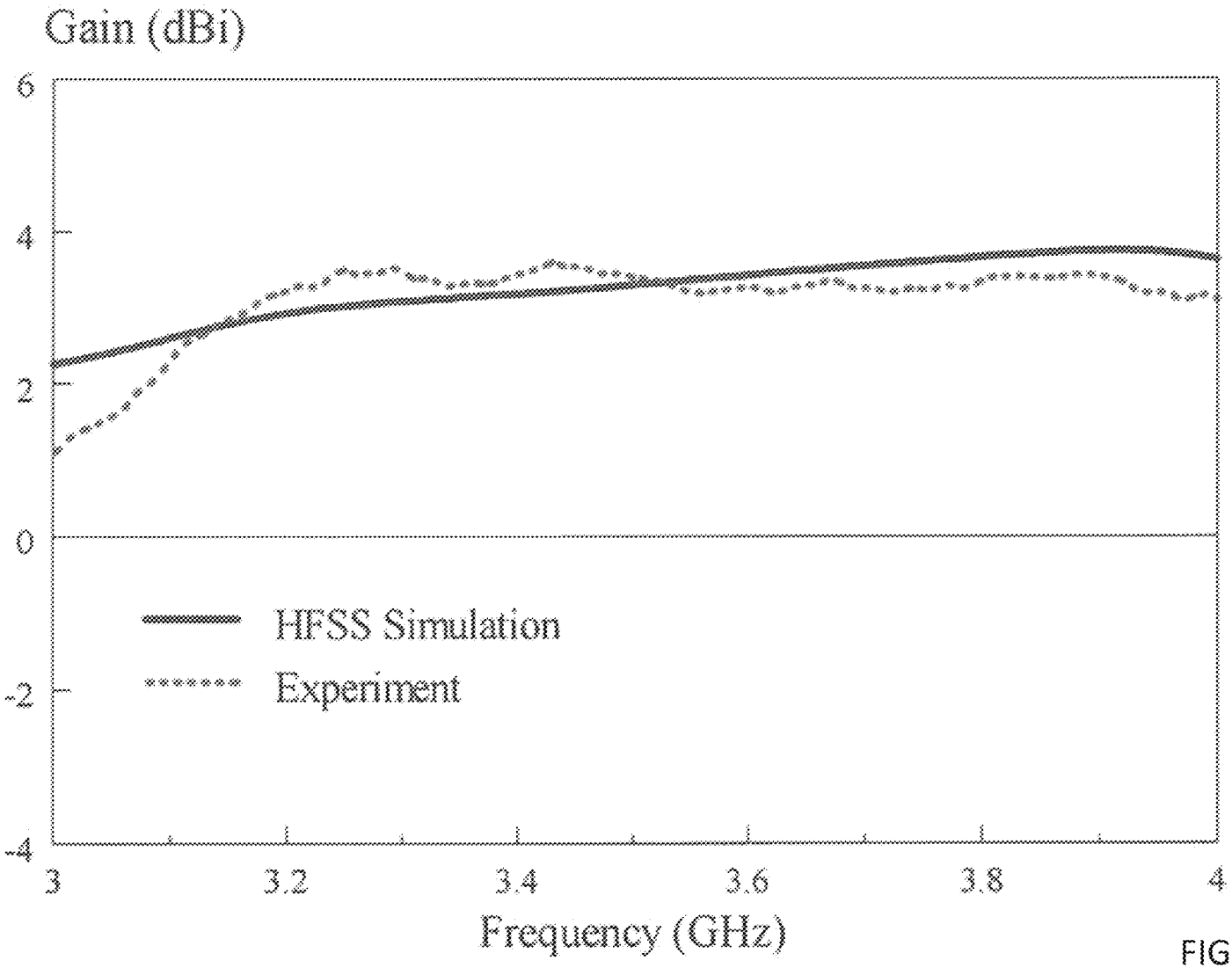
FIG. 10 is a plot showing simulated and measured gains of the antenna of FIG. 1.

With reference to FIG. 10, there is shown the measured and simulated gains. The measured gain varies between 3.19 dBi and 3.60 dBi over WiMax band. The gain variation of the simulated result is between 3.19 dBi and 3.55 dBi, which are slightly smaller than that of the measurement.

Figure 11:
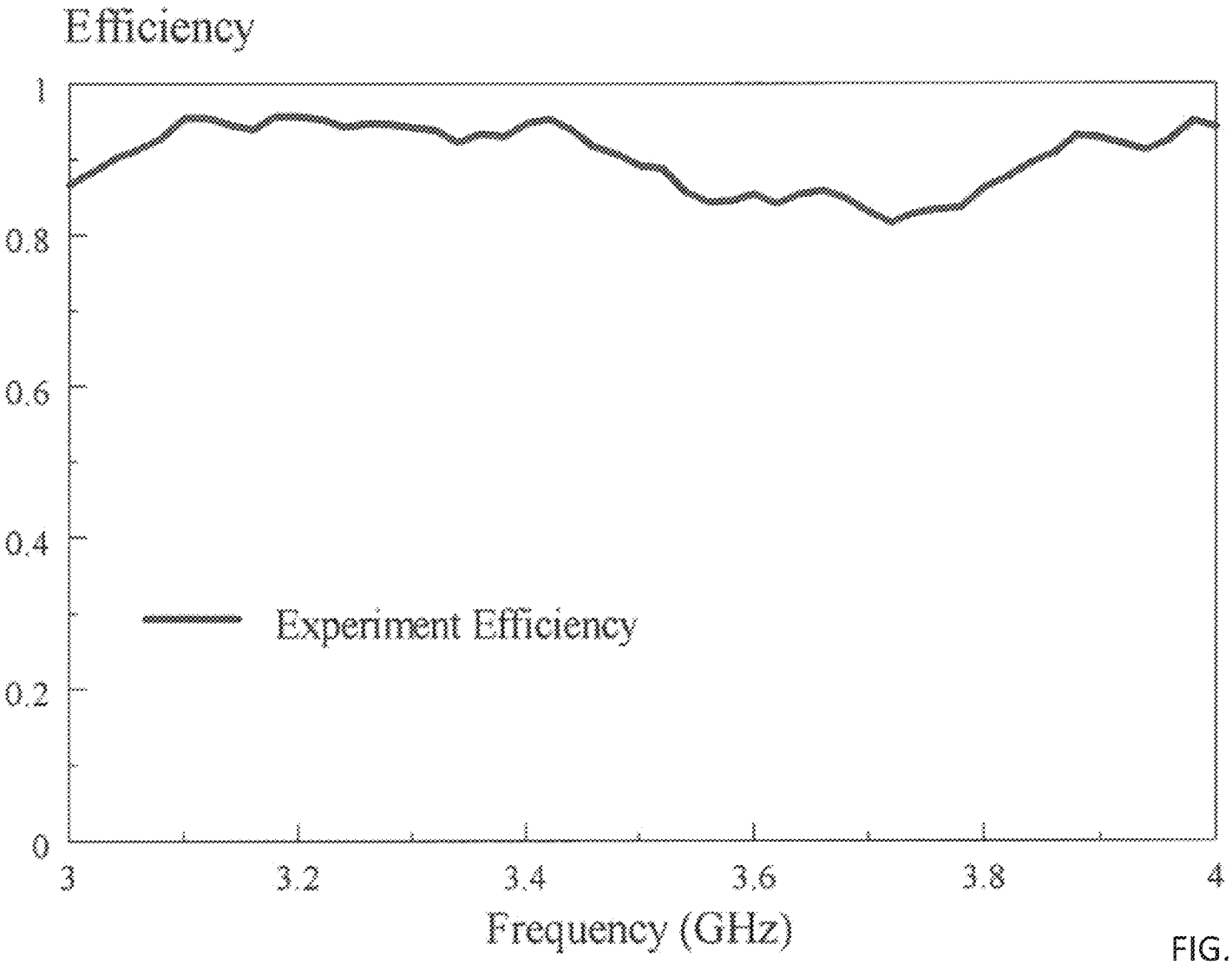
FIG. 11 is a plot showing measured efficiency of the antenna of FIG. 1.

With reference to FIG. 11, there is shown the efficiency of the antenna 100 that has taken impedance mismatch into accounts. The efficiency varies between 83.1% and 95.3% across WiMax band It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. An antenna comprising a dielectric resonator coupled to a ground plane provided on a substrate having a slot structure on the ground plane; and a monopole substantially surrounded by the dielectric resonator; wherein, when the monopole, the dielectric resonator and the slot structure are excited with an electrical signal, the combination of the monopole, the dielectric resonator and the slot structure is arranged to radiate an electromagnetic signal associated with the electrical signal in a substantially unidirectional manner.

2. An antenna in accordance with claim 1, wherein the combination of the dielectric resonator, the slot structure and the monopole defines a plurality of dipoles arranged to radiate the electromagnetic signal.

3. An antenna in accordance with claim 2, wherein the radiated electromagnetic signal has a complementary radiation pattern.

4. An antenna in accordance with claim 3, wherein the complementary radiation pattern in a first direction is defined by a construction interference of a plurality of electromagnetic radiation components contributed by the plurality of dipoles.

5. An antenna in accordance with claim 4, wherein the complementary radiation pattern in a second direction opposite to the first direction is defined by a destructive interference of the plurality of electromagnetic radiation components contributed by the plurality of dipoles.

6. An antenna in accordance with claim 3, wherein the plurality of dipoles comprises a magnetic dipole and an electric dipole perpendicular to the magnetic dipole.

7. An antenna in accordance with claim 3, wherein the plurality of dipoles comprises a horizontal magnetic dipole and a vertical electric dipole.

8. An antenna in accordance with claim 4, wherein the electromagnetic signal is radiated substantially along the first direction parallel to the ground plane.

9. An antenna in accordance with claim 6, wherein the magnetic dipole is defined by the combination of the dielectric resonator and the slot structure.

10. An antenna in accordance with claim 8, wherein the magnetic dipole is arranged to contribute at least one of the plurality of electromagnetic radiation components according to an $HEM_{11\delta+2}$ mode of the dielectric resonator and a slot-antenna mode of the slot structure.

11. An antenna in accordance with claim 6, wherein the electric dipole is defined by the monopole.

12. An antenna in accordance with claim 11, wherein the electric dipole is arranged to contribute at least one of the plurality of electromagnetic radiation components.

13. An antenna in accordance with claim 1, wherein the dielectric resonator comprises a hollow cavity along a central axis of the dielectric resonator.

14. An antenna in accordance with claim 13, wherein the monopole is substantially surrounded by the dielectric resonator within the hollow cavity along the central axis.

15. An antenna in accordance with claim 13, wherein the central axis is orthogonal to the ground plane.

16. An antenna in accordance with claim 13, wherein the slot structure substantially intercepts with the central axis.

17. An antenna in accordance with claim 16, wherein the slot structure is substantially elongated and perpendicular to a longitudinal axis on the ground plane.

18. An antenna in accordance with claim 17, wherein the slot structure is substantially offset from a midpoint on the ground plane along the longitudinal axis.

19. An antenna in accordance with claim 16, further comprising a microstrip line on the substrate, wherein the microstrip line and the ground plane are provided on opposite sides of the substrate.

20. An antenna in accordance with claim 19, wherein the microstrip line is electrically connected to the monopole.

21. An antenna in accordance with claim 19, wherein the microstrip line is arranged to at least partially overlaps with the slot structure on the substrate.

22. An antenna in accordance with claim 21, wherein the microstrip line is arranged to feed the slot structure.

23. An antenna in accordance with claim 19, further comprising a connector on an edge of the substrate distal from the slot structure along the microstrip line.

24. An antenna in accordance with claim 21, wherein the central axis is positioned at where the microstrip line overlaps with the slot structure.

25. An antenna in accordance with claim 1, wherein the dielectric resonator is a cylindrical ring dielectric resonator.

26. An antenna in accordance with claim 1, wherein the monopole is a cone monopole, an inverted cone monopole, a cylindrical monopole or a step-radius monopole.

27. An antenna in accordance with claim 1, wherein the slot structure is etched on the ground plane.

28. An antenna array comprising a plurality of antennas in accordance with claim 1.

* * * * *